US005906220A

United States Patent [19]

Thompson

[11] Patent Number: 5,906,220

[45] Date of Patent: May 25, 1999

[54] CONTROL SYSTEM WITH COLLECTION CHAMBER

[75] Inventor: Grant R. Thompson, Tulsa, Okla.

[73] Assignee: Baker Hughes Incorporated, Houston, Tex.

[21] Appl. No.: 08/586,265

[22] Filed: Jan. 16, 1996

[51] Int. Cl.[6] ..... F16K 31/363

[52] U.S. Cl. ..... 137/492.5; 137/488; 166/375; 166/321; 166/324

[58] Field of Search ..... 137/488, 492.5, 137/81.2; 251/28; 166/375, 321, 324, 386

[56] References Cited

U.S. PATENT DOCUMENTS

| | | | |
|---|---|---|---|
| 4,074,692 | 2/1978 | Shafer | 137/488 |
| 4,119,146 | 10/1978 | Taylor . | |
| 4,135,547 | 1/1979 | Akkerman et al. . | |
| 4,149,698 | 4/1979 | Deaton . | |
| 4,173,256 | 11/1979 | Kilgore . | |
| 4,234,043 | 11/1980 | Roberts . | |
| 4,252,197 | 2/1981 | Pringle . | |
| 4,325,409 | 4/1982 | Roberts . | |
| 4,373,587 | 2/1983 | Pringle . | |
| 4,431,051 | 2/1984 | Adams, Jr. . | |
| 4,448,254 | 5/1984 | Barrington . | |
| 4,467,867 | 8/1984 | Baker . | |
| 4,560,004 | 12/1985 | Winslow et al. . | |
| 4,569,398 | 2/1986 | Pringle . | |
| 4,636,934 | 1/1987 | Schwendemann et al. . | |
| 4,660,646 | 4/1987 | Blizzard . | |
| 4,664,196 | 5/1987 | Manke . | |
| 4,676,307 | 6/1987 | Pringle . | |
| 5,101,904 | 4/1992 | Gilbert . | |
| 5,209,303 | 5/1993 | Barrington . | |
| 5,244,044 | 9/1993 | Robertson | 137/492.5 X |
| 5,251,702 | 10/1993 | Vazquez . | |
| 5,415,237 | 5/1995 | Strattan . | |
| 5,564,501 | 10/1996 | Strattan et al. . | |

FOREIGN PATENT DOCUMENTS

| | | | |
|---|---|---|---|
| 2704754 | 8/1978 | Germany | 137/492.5 |
| 1577828 | 10/1980 | United Kingdom . | |
| 2163793 | 5/1986 | United Kingdom . | |
| 2183695 | 6/1987 | United Kingdom . | |

OTHER PUBLICATIONS

Camco Catalog, TRC Series Pressure Charged Safety Valves, 1992–1993, pp. 48–49.

*Primary Examiner*—Kevin Lee
*Attorney, Agent, or Firm*—Rosenblatt & Redano P.C.

[57] ABSTRACT

A control system for the operation of the subsurface safety valve is disclosed. The control system uses a pressurized gas chamber, as well as a shuttle valve which connects to the main fluid pressure supply from the surface. The shuttle valve is connected to the gaseous chamber as well as to a barrier piston. As a result of the arrangement, leakages between the downstream side of the operating piston and the shuttle valve result in a reestablishment of the pressure balance on the operating system which allows the subsurface safety valve to close. Additionally, in the event of loss of gaseous pressure, the same pressure-balancing effect occurs on the operating piston, which allows the subsurface safety valve to go to a closed position. The configuration of the control system, which includes a gaseous chamber, allows for disconnection of the hydraulic fluid supply before the predetermined depth is reached to facilitate the connection of a tubing hanger.

27 Claims, 5 Drawing Sheets

CONTROL SYSTEM WITH COLLECTION CHAMBER

FIELD OF THE INVENTION

The field of this invention relates to hydraulic control systems, particularly those suitable for use with subsurface safety valves.

BACKGROUND OF THE INVENTION

Subsurface safety valves have been used for many years in producing wells. These valves are generally operated by a movable sleeve. The movable sleeve holds the valve open in one position and allows a flapper element to close the passageway to the surface when placed in a second position. Typically, hydraulic control systems have been in use for actuation of the shifting tube to control the position of the subsurface safety valve. Generally, these hydraulic control systems involve a piston cylinder assembly which acts on the flow tube to open the safety valve. Some of these control systems have involved pressurized gaseous chambers which act on other movable pistons within the control system, and have been used in the past to facilitate the operation of the control system. Pressurized gas chambers counteract the hydrostatic pressure in the control line when the assembly is installed at depth. One of the problems that have occurred in such control systems involving pressurized gaseous chambers is that there is a precharge of pressure in the gaseous chamber which is precalculated for the given depth and installation of the subsurface safety valve. However, in the installation techniques, the control line sometimes needs to be taken apart prior to the subsurface safety valve having reached the appropriate depth. When those situations have arisen, there was a pressure imbalance because the hydrostatic head, before the predetermined depth was reached in the control line, was overcome by the precharged pressure in the gaseous chamber. Since installation techniques, particularly in subsea applications, required disconnection of a control line in order to facilitate the connection of a tubing hanger, the prior control systems, without the unique features as Will be discussed with regard to the present invention, posed the potential risk of having control fluid expelled from the control line at the time the disconnection was necessary.

Prior control systems also relied on a single valve actuated by control line pressure to open a fluid passage between the fluid in communication with a lower piston and the collection chamber, and further to close off communication between the lower piston and the upper piston. This type of a system had a disadvantage involving the time between the opening of the one fluid passage and the closure of the other. In an intermediate position, the control line pressure was in communication with all areas of the system. If the control line pressure and the flow rate were incapable of moving the valve quickly into its final position, the control line fluid would be pumped into the gaseous chamber.

Accordingly, a new control system has been developed to create a barrier between the gaseous chamber and other portions of the circuit so that the gaseous chamber pressure charge is not lost when the control line pressure is dropped, such as when the control line needs to be disconnected to connect a tubing hanger. The additional barrier piston which has been provided in the present invention overcomes the problem of the main piston adopting an intermediate position, which, in prior designs, allowed the fluid into the gaseous chamber. A boost piston also ensures full operation of the main piston if a system leak develops. Accordingly, another object of the apparatus and method of the present invention is to eliminate sensitivity by the control system to the rate at which pressure is applied to the system. In the event of leakages in critical areas, such as a gaseous leak or a hydraulic fluid leak, the actuating piston that operates the subsurface safety valve is placed in pressure balance so that the subsurface safety valve can close.

SUMMARY OF THE INVENTION

A control system for the operation of the subsurface safety valve is disclosed. The control system uses a pressurized gas chamber, as well as a shuttle valve which connects to the main fluid pressure supply from the surface. The shuttle valve is connected to the gaseous chamber as well as to a barrier piston. As a result of the arrangement, leakages between the downstream side of the operating piston and the shuttle valve result in a reestablishment of the pressure balance on the operating system which allows the subsurface safety valve to close. Additionally, in the event of loss of gaseous pressure, the same pressure-balancing effect occurs on the operating piston, which allows the subsurface safety valve to go to a closed position. The configuration of the control system, which includes a gaseous chamber, allows for disconnection of the hydraulic fluid supply before the predetermined depth is reached to facilitate the connection of a tubing hanger.

DETAILED DESCRIPTION OF THE PREFERRED EMBODIMENT

Figure 1:
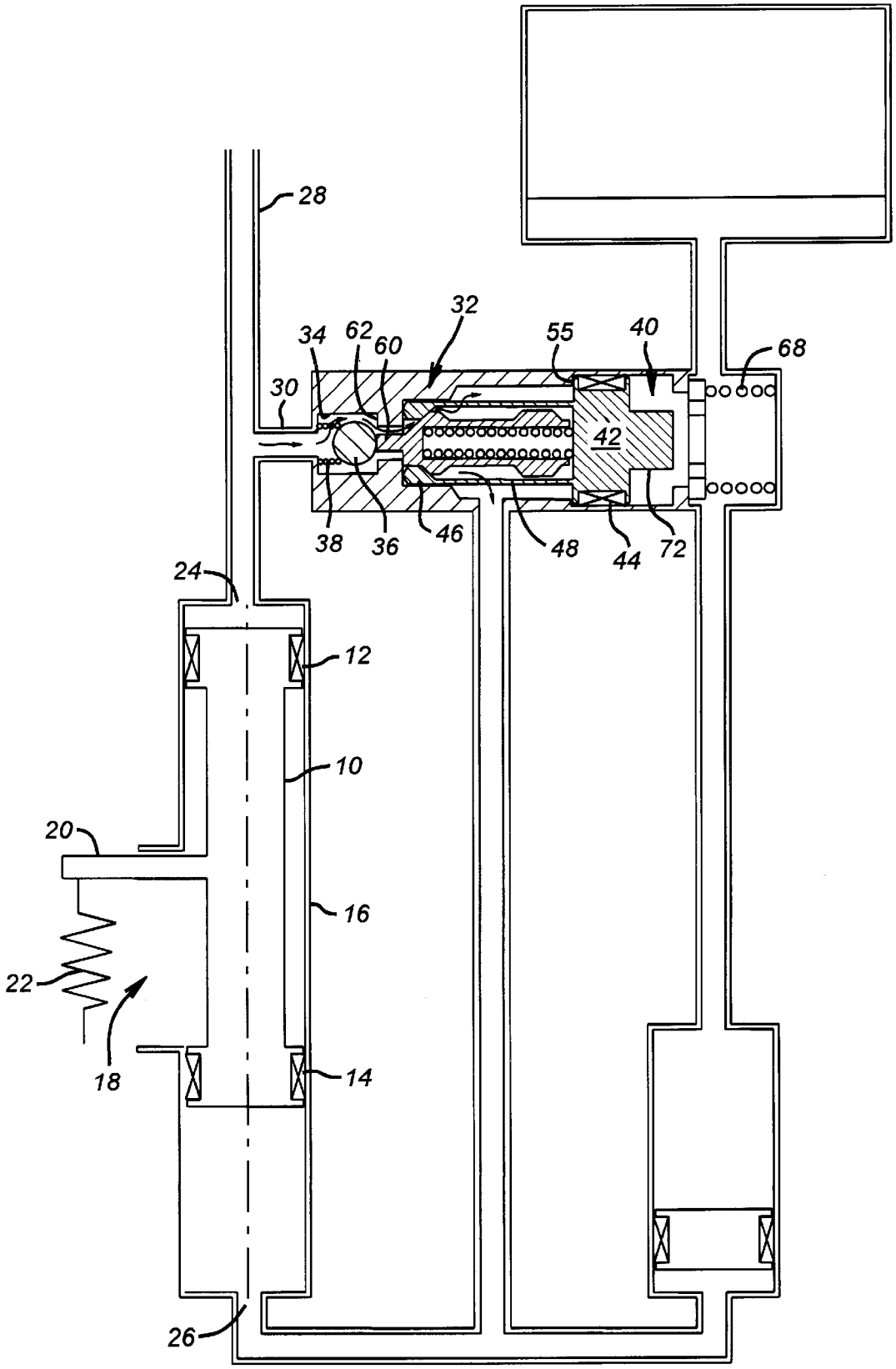
FIG. 1 illustrates the run-in position where the pressure in the nitrogen chamber exceeds the pressure in the control line.
Figure 3:
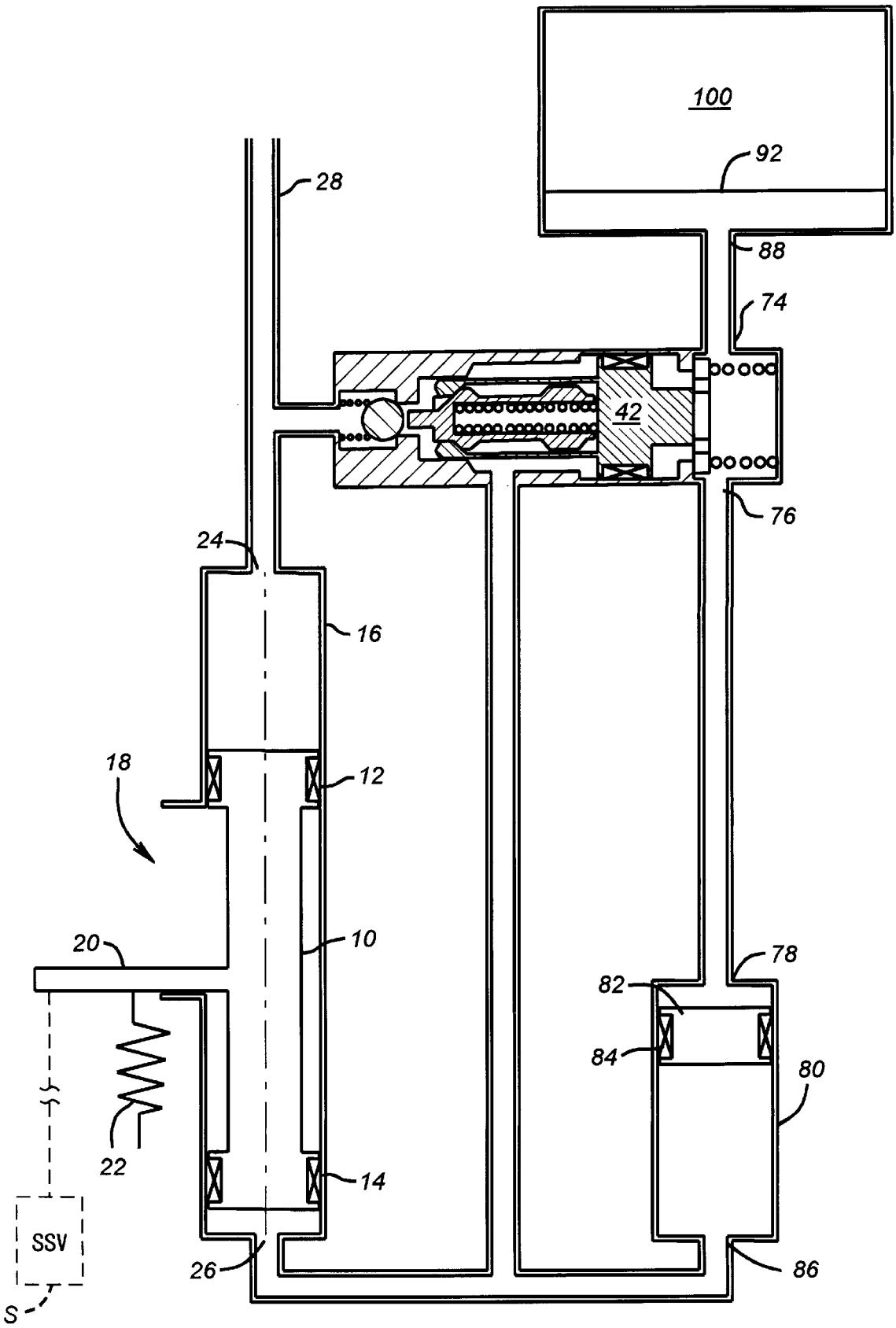
FIG. 3 shows the control line supply pressure equal or greater to the opening pressure of the subsurface safety valve, which results in the opening of the subsurface safety valve.

FIG. 1 illustrates the control system of the present invention. The assembly illustrated in FIG. 1 is run into the wellbore in close proximity of the subsurface safety valve. The arrangement solely with respect to the dynamic piston 10 is well-known in prior control systems. In this system, as well as prior control systems, a dynamic piston 10 has an upper seal 12 and a lower seal 14. The dynamic piston 10 is operable in a main cylinder 16, which has an opening 18 to accommodate extending tab 20. Extending tab 20 is schematically illustrated as being biased by a spring 22. The tab 20 is connected to the dynamic piston 10 within main cylinder 16 which in turn is used to control the position of the subsurface safety valves in a known manner. Thus, in this system, as in past systems, when the dynamic piston 10 is in fluid pressure balance, which means that the pressure at inlet or upper connection 24 is the same as the outlet or lower connection 26, the force of spring 22 moves the tab 20 upwardly to resume a position such as shown in FIG. 1 where the subsurface safety valve is closed. On the other hand, when the pressure from the surface is elevated to a sufficient degree, as shown in FIG. 3, the dynamic piston 10 is shifted downwardly within the cylinder 16 to open the subsurface safety valves.

The various other components of the control system will now be described. As shown in FIG. 1, a control line 28 extends from the surface down to inlet 24, as well as to inlet 30 of the shuttle control valve assembly 32. Inlet 30 is offset at an angle to line 28 so that any foreign material in the control line will not foul seat 62. The shuttle valve assembly 32 has located therein an initial chamber 34 within which is housed a ball or poppet 36 biased by a spring 38.

Figure 2:
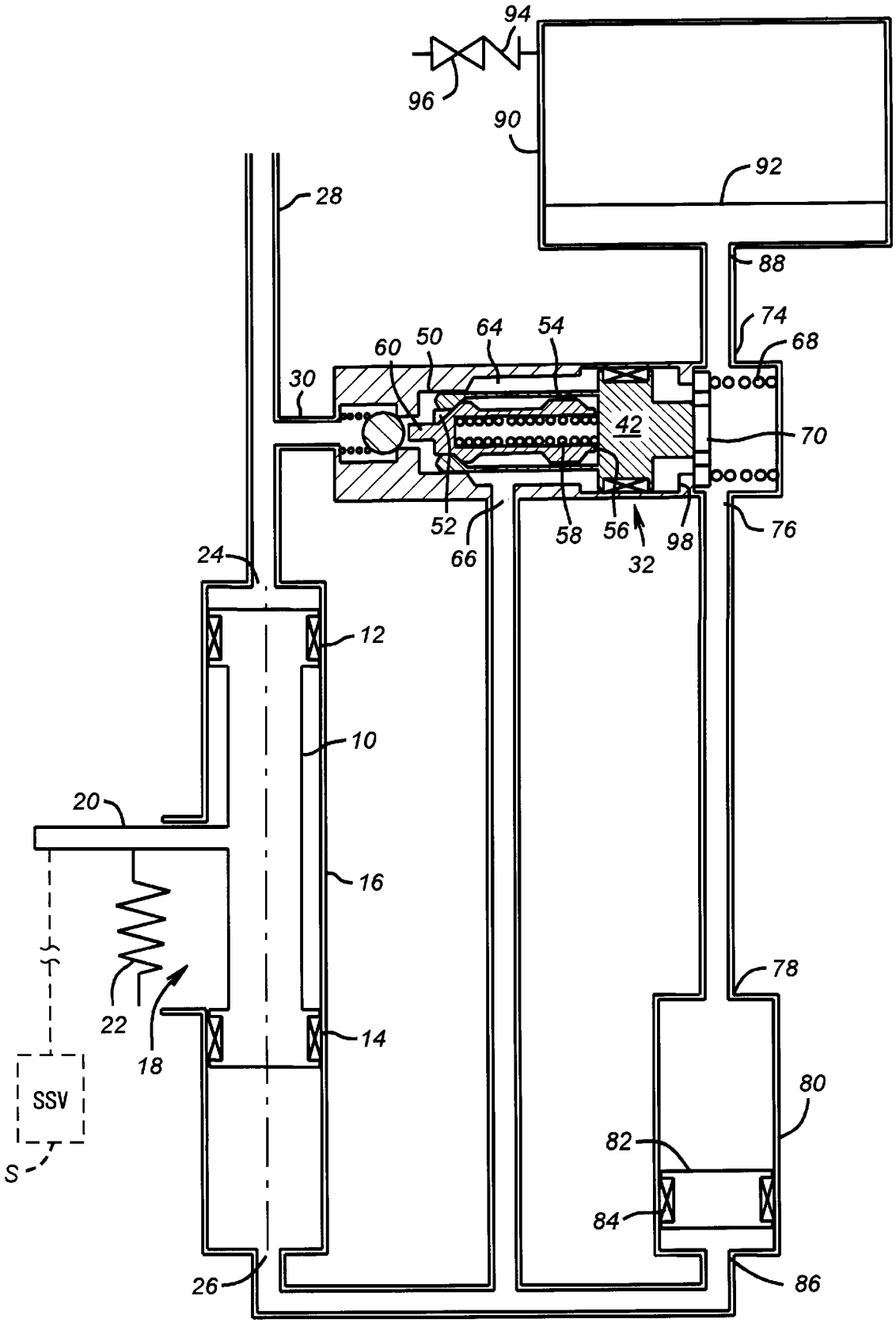
FIG. 2 shows an increase in the supply pressure, bringing it to a leval slightly greater than that of the gas pressure in the chamber.

The shuttle valve assembly 32 also has a second chamber 40 within which rides piston 42. Piston 42 is sealed at its periphery by seal 44. The piston 42 is configured to have one or more collets 46 which extend longitudinally on fingers 48. The collets 46, when supported against surface 50 (see FIG. 2), are trapped into an abutting relationship with surface 52 of secondary piston 54. Secondary piston 54 is therefore trapped between surface 56 of piston 42 and collets 46. Embedded spring 58 is trapped in the compressed position, as seen in FIGS. 1 and 2, within the secondary piston 54 and is held in that position when the collets 46 hold the secondary piston 54 trapped at surface 52. Using the biasing force of spring 58, the surface 52 abuts the collets 46, and a tab or plunger 60 abuts ball 36 and holds it off ball seat 62 (see FIG. 1). When the pressure in chamber 90 exceeds the pressure in control line 28, the pressure imbalance acting on seal 44 moves piston 42 against its stop 55.

The initial chamber 34 is then in flow communication with subchamber 64, which is created within the second chamber 40 by the presence of the piston 42. The subchamber 64 (see FIG. 2) is in fluid communication with port 66. Referring now to FIG. 1, the shuttle valve assembly 32 further incorporates a return spring 68 acting on a bumper plate 70. In the position shown in FIG. 1, the piston 42 has a tab 72 which is out of contact with the plate 70.

Referring again to FIG. 2, the shuttle valve assembly 32 also includes ports 74 and 76. Port 76 is in communication with port 78 on barrier or compensating cylinder 80. Barrier cylinder 80 has a piston 82 therein with a circumferential seal 84. Outlet 26 is thus in fluid communication with port 66 and port 86, with port 86 being on the barrier cylinder 80. Port 74 is in fluid communication with port 88 on reservoir 90. In the preferred embodiment, the reservoir 90 has a level of a fluid, preferably silicone, indicated as 92. The reservoir 90 can be filled through a check valve 94 and a block valve 96 (see FIG. 2). As a result, the secondary chamber 40 up to piston 42 is filled with silicone all the way down to piston 82 of the barrier cylinder 80.

The essential components of the control system now having been described, its operation will be reviewed in more detail. FIG. 1 represents the run-in position where the pressure in chamber 90 exceeds the pressure in the control line 28 adjacent inlet 30. As long as that situation persists, the tab 60 keeps the ball 36 off of ball seat 62. This has the result of putting inlet 30 in fluid communication with port 66, which, in effect, equalizes the pressure at inlet 24 with outlet 26. In that situation, the spring 22 keeps the tab 20 in the upper position shown and the subsurface safety valves is closed.

Figure 4:
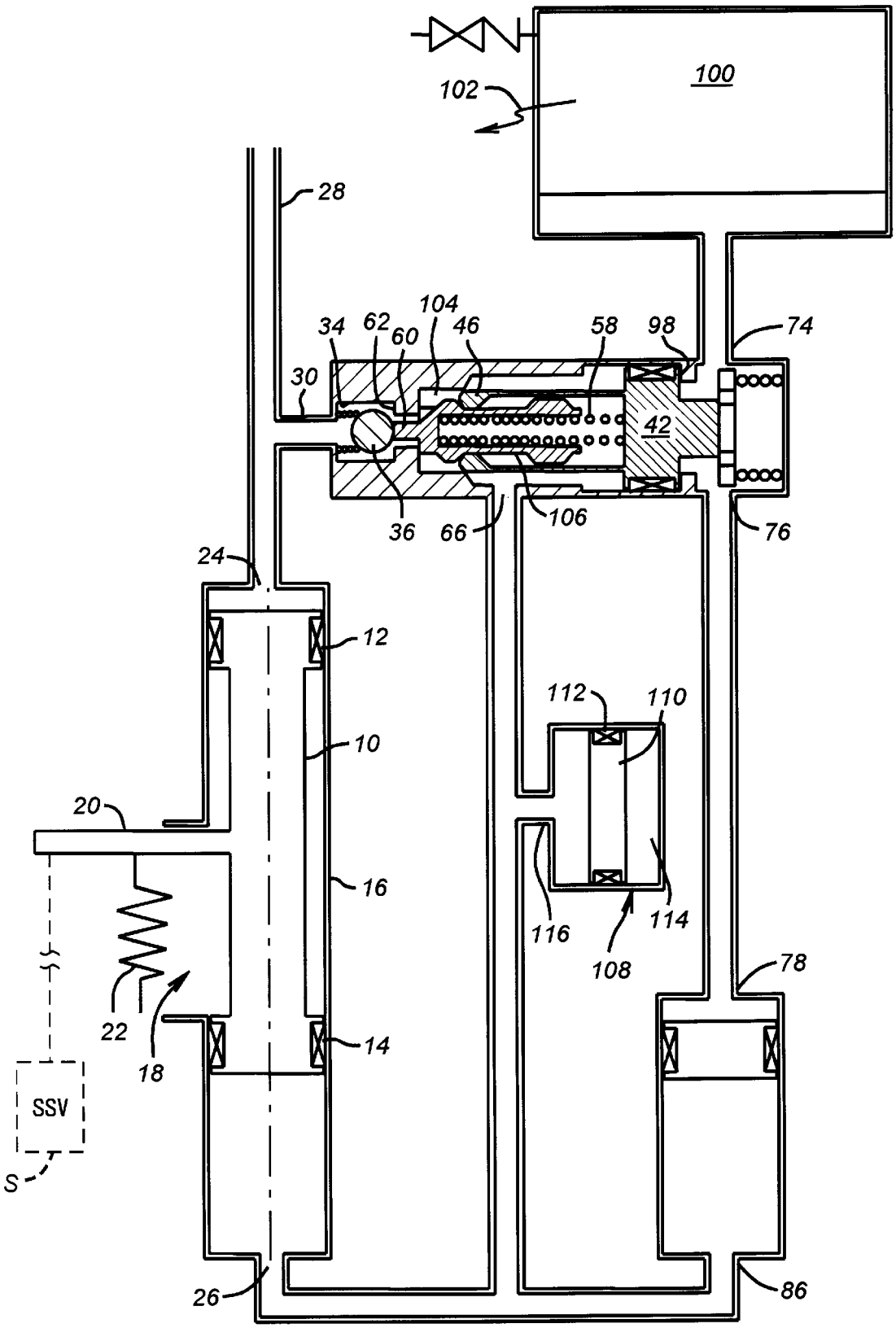
FIG. 4 shows the reaction of the system upon loss of gas pressure from the chamber.

FIG. 2 illustrates a further increase in pressure in the control line. Upon reaching a predetermined value in the control line 28, a net differential force on piston 42 occurs, shifting it toward bumper plate 70. Piston 42 has a travel stop 98 limiting its movement toward the bumper plate 70. As seen in FIG. 4, ultimately the spring 68 with the bumper plate 70 are both compressed until the piston 42 hits the travel stop 98.

Thus, with a slightly elevated pressure, the seating of ball 36 against the ball seat 62 in effect closes off inlet 30 from port 66. At this point, pressure buildup in the control line 28 will move the dynamic piston 10, as can be seen by comparing FIGS. 2 and 3. As can also be seen by comparing FIGS. 2 and 3, the dynamic movement of the piston 10 results in upward movement of the barrier piston 82 in a direction from port 86 to port 78. Thus, FIGS. 1, 2, and 3 illustrate the normal operation of the control system. The piston 82 can move upwardly toward port 78 because the reservoir 90 has a compressible fluid 100, preferably nitrogen, which compensates for the displaced volume resulting from the motion of the dynamic piston 10 and the corresponding motion of piston 82. It should be noted as the dynamic piston 10 is moving downwardly, the spring 68 exerts a force on the bumper plate 70, which at this time is in contact with the tab 72 on the piston 42. Thus, the displacement of the dynamic piston 10 moves the fixed volume of hydraulic fluid through the outlet 26, with the path of least resistance being into port 86 to displace the barrier piston 82 toward outlet 78. That resistive force is less than the resistive force against the piston 42, which is applied by the piston 42 to port 66. This result can also be obtained by making the piston 82 smaller than piston 42. Since the same fluid pressure of the nitrogen 100 acts on both pistons, the piston with the smallest area will offer less resistive force.

Figure 5:
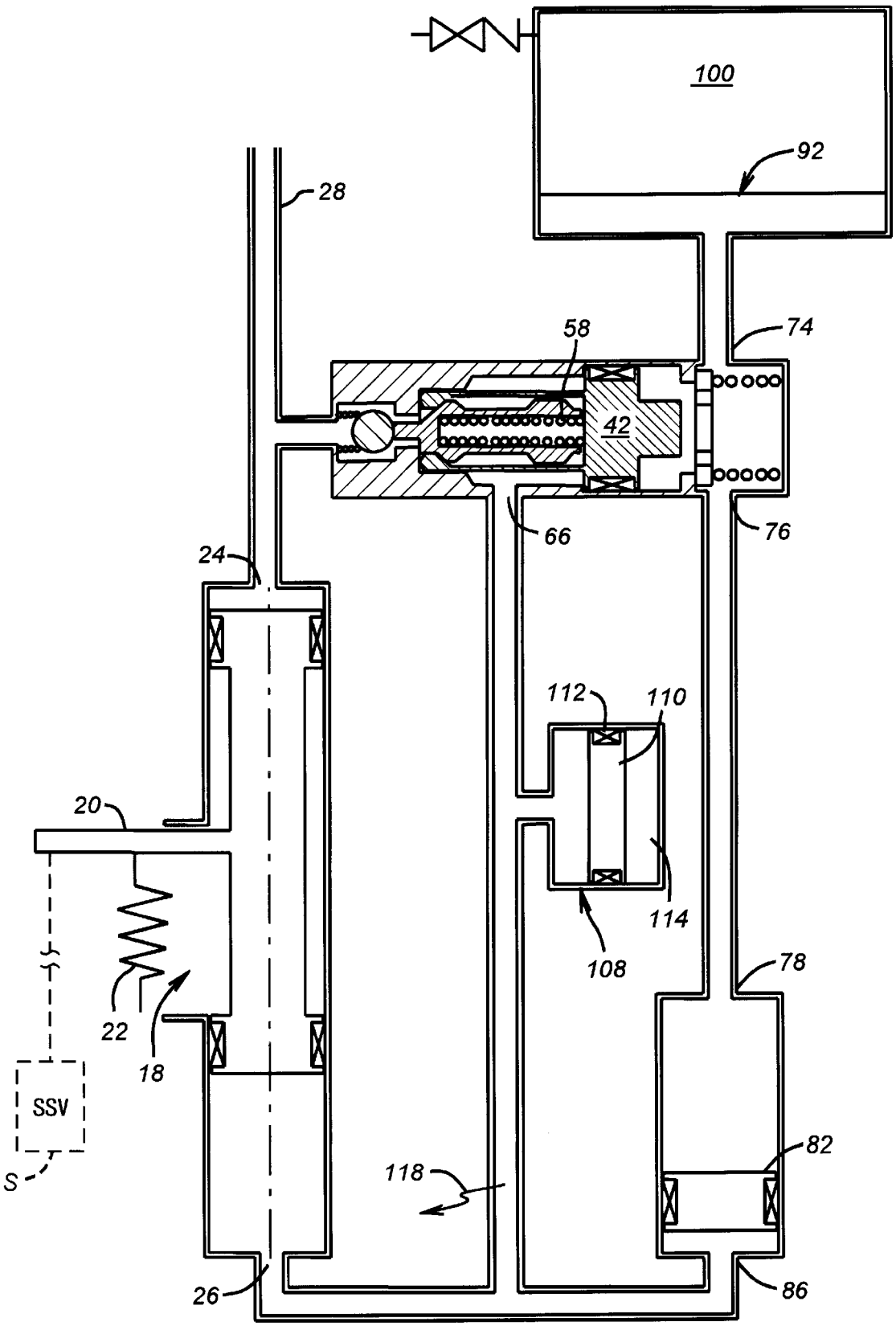
FIG. 5 shows the reaction of the control system from a leakage in the control lines downstream of the main operating cylinder.

Having described the normal operation of the system, how the system responds to loss of nitrogen pressure from the reservoir 90 will be described with regard to FIG. 4. FIG. 5 deals with the loss of hydraulic fluid from anywhere between outlet 26, port 66, and port 86. Referring now to FIG. 4, arrow 102 represents schematically the loss of nitrogen pressure 100. When that occurs, there is a sudden reduction of pressure at port 74 and 76. As a result, the piston 42 can move against its travel stop 98. This frees the collets 46 as they move out from contact with surface 104. This allows the collets 46 to ride along tapered surface 52 to assume the position in FIG. 4 adjacent surface 106. With the collets 46 in the position shown in FIG. 4, the spring 58 now can move the secondary piston 54 toward initial chamber 34. The net result of that motion is that tab 60 displaces ball 36 away from ball seat 62. When that occurs, the inlet 30 is in flow communication with the port 66, which then equalizes the pressure between inlet 24 and outlet 26. When that occurs, the dynamic piston 10 is in pressure balance within the control system and spring 22 can push on tab 20 to move the sleeve (not shown) which controls the subsurface safety valve (not shown) to allow the subsurface safety valves to close.

It should further be noted that with regard to the loss of the nitrogen pressure, as reflected by arrow 102, piston 82 retains its position in the barrier cylinder 80. This is because with the loss of nitrogen due to leak 102, the pressure at port 78 falls below port 86. In essence, the release of secondary piston 54 in combination with spring 58 results in the unseating of ball 36 and equalization of pressure between inlet 24 and outlet 26 to allow the subsurface safety valve's to close.

Also coming into play at this time is cylinder 108, which has a piston 110 and a seal 112 (see FIG. 5). In the preferred embodiment, pressurized nitrogen is located in space 114, generally the same pressure as the nitrogen 100 in reservoir 90. The cylinder 108 is located between port 66 and outlet 26 and port 86. The cylinder 108 acts as a booster so that, depending on the size of the leak, represented by arrow 102, sufficient force is available to move the piston 42 toward travel stop 98 as the pressure in chamber 114 moves the piston 110 toward the outlet 116. This gives a boost force to piston 42 through port 66 to ensure that it travels sufficiently to the travel stop 98 so that collets 46 release the secondary piston 54. Cylinder 108 may be needed if the leak 102 is small and the volume between outlet 26, port 86, and port 66 cannot move piston 42 enough as subchamber 64 volume increases upon movement of piston 42 toward plate 70.

FIG. 5 illustrates a situation where a leak occurs between the outlet 26, port 86, and port 66. The leak is represented schematically by arrow 118. When there is a leak, such as 118, the pressure decreases at port 66, makes the pressure at port 74 or 76 greater than the pressure at port 66, thus creating an unbalanced force on piston 42 to move it to the left, as seen by comparing FIGS. 3 and 5. As the piston 42 moves in a direction away from its travel stop 98, the compensating piston 82 has been displaced fully toward port 86 due to the result of leak 118. When leak 118 occurs, differential pressure across piston 82 makes it move to the position shown in FIG. 5. The higher pressure is provided from the nitrogen 100 which communicates through the silicone 92 to port 78. Since due to the leak 118 the pressure at port 78 becomes larger than the pressure at port 86, piston 82 shifts toward port 86. When piston 82 bottoms, the resultant nitrogen pressure 100 further displaces the piston 42, which has the effect of unseating ball 36 from ball seat 62, thus equalizing the pressure at inlet 24 with outlet 26 which again allows the dynamic piston 10 to move upwardly under the force of spring 22., The net result is that the subsurface safety valve (not shown) moves to a closed position.

The operation of the control system having been fully described, those skilled in the art can readily appreciate that several advantages over prior systems are revealed. Initially, if the control line 28 needs to be disconnected before the assembly shown in the figures reaches the predetermined depth, the silicone 92 remains contained between piston 82 and piston 42. Further, if there is a failure, either by loss of the nitrogen pressure 100, as indicated by arrow 102, or by a leakage between outlet 26 and ports 66 and 86, as indicated by arrow 118, the net result is the control system puts the subsurface safety valves in a closed condition.

Another advantage of this system is that it avoids an intermediate position of the piston 42, which in prior designs allowed excessive amounts of hydraulic fluid to enter the chamber 90. This design provides a barrier piston 82 between the fluid and the hydraulic circuit and the chamber 90. The presence of such a barrier allows disconnection of the control line 28, even though the nitrogen pressure 100 is preset for a particular depth. If there is a disconnection of the control line before reaching the design depth, the pressure imbalance between the nitrogen 100 and the hydrostatic pressure in the control line 28 is irrelevant because the silicone 92 is isolated by pistons 42 and 82. The presence of the barrier piston 82 also reduces the control system's sensitivity to the rate at which the control pressure is applied. This system is also insensitive to changes in the applied hydraulic pressure through the control line 28. Finally, with the use of the reservoir 90 with the nitrogen pressure 100 acting on the layer of silicone 92, the control circuitry is insensitive to the hydrostatic forces in the wellbore, as well as in the control line 28 leading from the surface.

The foregoing disclosure and description of the invention are illustrative and explanatory thereof, and various changes in the size, shape and materials, as well as in the details of the illustrated construction, may be made without departing from the spirit of the invention.

We claim:

1. A control system for a subsurface safety valve, comprising:

a subsurface safety valve;

a biased main piston operably connected to said subsurface safety valve through an opening in a main cylinder in which said main piston is reciprocally mounted, said main cylinder having an upper connection and a lower connection;

a control valve mounted in parallel to said main cylinder to selectively prevent pressure applied at said upper connection from being applied at said lower connection on said main cylinder;

at least one compensating piston in at least one compensating cylinder, said compensating piston being displaced responsive to movement of said main piston between said upper and lower connections thereof;

said compensating cylinder having a first connection in fluid communication with a pressurized fluid reservoir on the opposite side of said compensating piston from said main cylinder;

said pressurized fluid reservoir operably connected to said control valve to counteract hydrostatic forces of a control fluid column from the surface to said upper connection of said main cylinder.

2. The control system of claim 1, wherein:

said control valve equalizing pressure at said upper and lower connections of said main cylinder upon a predetermined decrease in pressure of said fluid in said pressurized fluid reservoir.

3. The control system of claim 1, wherein:

said control valve equalizing pressure at said upper and lower connections of said main cylinder upon a predetermined decrease in hydraulic fluid pressure from a zone defined by said lower connection on said main cylinder, said compensating piston, and said control valve.

4. The control system of claim 1, wherein said control valve further comprises:

a control piston dividing the body of said control valve into a first and a second subchamber said first subchamber comprises an inlet in flow communication with said upper connection of said main cylinder and an outlet in flow communication with said lower connection of said main cylinder, and a valve assembly operably connected to said control piston and selectively isolating said inlet and outlet of said subchamber;

said second subchamber in flow communication with said pressurized fluid reservoir.

5. The control system of claim 4, wherein said valve assembly comprises:

a valve seat;

a biased sealing member;

a plunger operably connected to said control piston, said plunger overcoming said bias force on said sealing member to hold said inlet open to said outlet in said first subchamber until said control piston is displaced a predetermined value against said pressure in said pressurized fluid reservoir.

6. The control system of claim 5, wherein:

a return spring in said second subchamber which acts on said control piston after sufficient movement thereof to allow said plunger to retract from said biased sealing member, which in turn allows said sealing member to contact said valve seat to isolate said lower connection from said upper connection on said main cylinder.

7. The control system of claim 6, wherein:

said return spring prevents movement of said control piston responsive to differential pressure build-up across said main piston which in turn allows said compensating piston to be displaced against said fluid pressure in said reservoir responsive to movement of said main piston.

8. The control system of claim 7, wherein:

said control piston further comprising a retainer extending into said first subchamber;

said plunger retained by said retainer for a predetermined portion of movement of said control piston;

said plunger biased away from said control piston;

whereupon sufficient loss of fluid pressure from said pressurized fluid reservoir, sufficient movement of said control piston liberates said plunger from said retainer to allow said plunger to contact said biased sealing member to move it off said valve seat, whereupon said upper and lower connections of said main cylinder are equalized.

9. The control system of claim 5, further comprising:

a boost piston in fluid communication with said lower connection of said main cylinder, said boost piston subjected to pressure;

whereupon a pressure loss of a predetermined value from said pressurized fluid reservoir, said boost piston is biased to displace control fluid toward said control piston through said outlet of said first subchamber of said control valve to assist said control piston to strike sufficiently to allow said plunger to move said biased sealing member from said valve seat.

10. The control system of claim 6, wherein:

said return spring biases said control piston on removal of control fluid pressure from said inlet to said main piston or on loss of a predetermined hydraulic pressure among said compensating piston, said lower connection of said main cylinder and said outlet of said first subchamber of said control valve;

said control piston moving in tandem with said plunger, in that event, to move said biased sealing member away from said valve seat.

11. The control system of claim 8, wherein:

said retainer traps said plunger so that they move in tandem toward said biased sealing member unless said control piston moves a predetermined distance away from said biased sealing member, in which event said plunger is released by said retainer and biased away from said control piston to separate said biased sealing member from said valve seat.

12. The control system of claim 1, wherein:

said pressurized fluid reservoir contains a combination of a compressible gas under pressure and a substantially incompressible compensation fluid, said compensation fluid isolated from said control fluid by said control piston and said compensating piston.

13. The control system of claim 2, further comprising:

a boost piston under fluid pressure, having one side thereof in fluid communication with said lower connection of said main cylinder, whereupon loss of a predetermined value from said pressurized fluid reservoir, said boost piston assists said control valve in movement to facilitate pressure equalization between said upper and lower connections of said main cylinder.

14. The control system of claim 13, wherein:

said boost piston has an independent supply of a compressible gas which forms a part of said pressurized fluid reservoir.

15. The control system of claim 2, wherein:

said control valve equalizing pressure at said upper and lower connections of said main cylinder upon a predetermined decrease in hydraulic fluid pressure from a zone defined by said lower connection on said main cylinder, said compensating piston, and said control valve.

16. The control system of claim 15, wherein said control valve further comprises:

a control piston dividing the body of said control valve into a first and a second subchamber said first subchamber comprises an inlet in flow communication with said upper connection of said main cylinder, and an outlet in flow communication with said lower connection of said main cylinder and a valve assembly operably connected to said control piston and selectively isolating said inlet and outlet of said subchamber;

said second subchamber in flow communication with said pressurized fluid reservoir.

17. The control system of claim 16, wherein said valve assembly comprises:

a valve seat;

a biased sealing member;

a plunger operably connected to said control piston, said plunger overcoming said bias force on said sealing member to hold said inlet open to said outlet in said subchamber until said first control piston is displaced a predetermined value against said pressure in said pressurized fluid reservoir.

18. The control system of claim 17, wherein:

a return spring in said second subchamber which acts on said control piston after sufficient movement thereof to allow said plunger to retract from said biased sealing member, which in turn allows said sealing member to contact said valve seat to isolate said lower connection from said upper connection on said main cylinder.

19. The control system of claim 18, wherein:

said return spring prevents movement of said control piston responsive to differential pressure build-up across said main piston which in turn allows said compensating piston to be displaced against said fluid pressure in said reservoir responsive to movement of said main piston.

20. The control system of claim 19, wherein:

said control piston further comprising a retainer extending into said first subchamber;

said plunger retained by said retainer for a predetermined portion of movement of said control piston;

said plunger biased away from said control piston;

whereupon sufficient loss of fluid pressure from said pressurized fluid reservoir, sufficient movement of said control piston liberates said plunger from said retainer to allow said plunger to contact said biased sealing member to move it off said valve seat, whereupon said upper and lower connections of said main cylinder are equalized.

21. The control system of claim 20, further comprising:

a boost piston in fluid communication with said lower connection of said main cylinder, said boost piston subjected to pressure;

whereupon a pressure loss of a predetermined value from said pressurized fluid reservoir, said boost piston is biased to displace control fluid toward said control piston through said outlet of said first subchamber of said control valve to assist said control piston to shift sufficiently to allow said plunger to move said biased sealing member from said valve seat.

22. The control system of claim 21, wherein:

said return spring biases said control piston on removal of control fluid pressure from said inlet to said main piston or on loss of a predetermined hydraulic pressure among said compensating piston, said lower connection of said main cylinder and said outlet of said first subchamber of said control valve;

said control piston moving in tandem with said plunger, in that event, to move said biased sealing member away from said valve seat.

23. The control system of claim 22, wherein:

said retainer traps said plunger so that they move in tandem toward said biased sealing member unless said control piston moves a predetermined distance away from said biased sealing member, in which event said plunger is released by said retainer and biased away from said control piston to separate said biased sealing member from said valve seat.

24. The control system of claim 23, wherein:

said pressurized fluid reservoir contains a combination of a compressible gas under pressure and a substantially incompressible compensation fluid, said compensation fluid isolated from said control fluid by said control piston and said compensating piston.

25. The control system of claim 24, further comprising:

a boost piston under fluid pressure, having one side thereof in fluid communication with said lower connection of said main cylinder, whereupon loss of a predetermined value from said pressurized fluid reservoir, said boost piston assists said control valve in movement to facilitate pressure equalization between said upper and lower connections of said main cylinder.

26. The control system of claim 25, wherein:

said boost piston has an independent supply of a compressible gas which forms a part of said pressurized fluid reservoir.

27. A fluid control circuit for controlling a subsurface safety valve, comprising:

a subsurface safety valve;

a biased main piston riding in a main cylinder, said main cylinder having an upper port to receive control fluid from the surface and a lower port, said main piston having seals adjacent to its upper and lower ends and operably connected to the subsurface safety valve through an opening in said main cylinder;

a control valve assembly for selective flow alignment of said upper and lower ports through an inlet and outlet port, said control valve assembly comprising at least one pressure-compensation port flow isolated from said inlet and outlet ports;

a pressurized fluid reservoir circuit in flow communication with said pressure-compensation port and with a compensating piston movable in a compensating cylinder, said compensating cylinder having an inlet port in fluid communication with said pressurized fluid reservoir and an outlet port in fluid communication with said lower port of said main cylinder.

* * * * *